US008412582B1

(12) United States Patent
Darwin et al.

(10) Patent No.: US 8,412,582 B1
(45) Date of Patent: Apr. 2, 2013

(54) SYSTEM FOR MANAGING SALES LEADS FOR SALES PARTNERS OF A COMPANY

(75) Inventors: Dean Patrick Darwin, Maple Valley, WA (US); David John Janssen, Seattle, WA (US)

(73) Assignee: F5 Networks, Inc., Seattle, WA (US)

( * ) Notice: Subject to any disclaimer, the term of this patent is extended or adjusted under 35 U.S.C. 154(b) by 1381 days.

(21) Appl. No.: 11/380,169

(22) Filed: Apr. 25, 2006

(51) Int. Cl.
*G06Q 30/00* (2012.01)

(52) U.S. Cl. ..... 705/26.1; 705/26.41

(58) Field of Classification Search ..... 705/26–27, 705/28, 347–348, 26.1–27.2, 10–11
See application file for complete search history.

(56) References Cited

U.S. PATENT DOCUMENTS

| | | | | |
|---|---|---|---|---|
| 6,477,533 | B2 | 11/2002 | Schiff et al. | |
| 6,618,706 | B1 | 9/2003 | Rive et al. | |
| 6,662,164 | B1 | 12/2003 | Koppelman et al. | |
| 2002/0107761 | A1 | 8/2002 | Kark et al. | |
| 2002/0133383 | A1 | 9/2002 | Chao et al. | |
| 2004/0143483 | A1* | 7/2004 | Tivey et al. | 705/10 |
| 2004/0236607 | A1 | 11/2004 | Kost et al. | |
| 2005/0097000 | A1 | 5/2005 | Freishtat et al. | |
| 2005/0144075 | A1* | 6/2005 | Magowan et al. | 705/14 |
| 2007/0239514 | A1* | 10/2007 | Lissy et al. | 705/10 |
| 2007/0265928 | A1* | 11/2007 | Fuchs et al. | 705/26 |

OTHER PUBLICATIONS www.ABCLeads.com. Dec. 4, 2004. {recovered from www.Archive.org}.*

Moran, A. et al., "F5 Launches Powerful Incentive and Rewards Program for TrafficShield and FirePass Resellers," Dec. 13, 2004, F5 Press Release, 2 pages.

Moran, A. et al., "F5 Networks Broadens Partner opportunities with New and Updated Channel Support," Mar. 22, 2004, F5 Press Release, 2 pages.

"Welcome to the New F5 Advantage Partner Program," Partner Update Newsletter, F5 Networks, Inc., Nov. 22, 2005, 6 pages.

* cited by examiner

*Primary Examiner* — William Allen
(74) *Attorney, Agent, or Firm* — Frommer Lawrence & Haug LLP; John W. Branch

(57) ABSTRACT

A system and method are directed to providing a sales channel registration system that allows sales deals to be managed. Aspects of the invention include a sales portal that receives information relating to sales deals, mechanisms for qualifying sales leads, and mechanisms for notifying sales partners, distributors, or a company of new information or changes in status relating to sales deals. One aspect of the invention determines when there may be potential conflicts, and performs actions to prevent such conflicts.

12 Claims, 5 Drawing Sheets

SYSTEM FOR MANAGING SALES LEADS FOR SALES PARTNERS OF A COMPANY

FIELD OF THE INVENTION

The present invention relates to sales channels and, more particularly, to a system and method for managing the association between sales deals and sales partners.

BACKGROUND OF THE INVENTION

Businesses often use business partners to sell the goods and services provided by the business. Commonly, a company many have multiple business partners that have non-exclusive rights to market and sell to customers. In such situations, managing the business partners is an important aspect of the sales process.

Business may employ one or more business rules for managing multiple business partners. One such rule may provide a specific partner with exclusivity in the sales process with respect to potential customers. Exclusivity may be based on geography, customer size, customer type, product type, or other factors. Some business partners may have non-exclusive rights to sell to customers, allowing one or more partners to sell to a customer. In situations where two or more partners may have the right to market and sell to a common customer, questions may arise as to how to manage the competing interests of the partners. In some situations, the incentives for a partner to approach and sell to a customer may be insufficient. Additionally, it is desirable to provide partners with tools and information to assist them in order to make efficient use of each partner's resources, and to improve sales. It is with respect to these considerations and others that the present invention has been made.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified.

For a better understanding of the present invention, reference will be made to the following Detailed Description of the Preferred Embodiment, which is to be read in association with the accompanying drawings, wherein.

DETAILED DESCRIPTION OF THE PREFERRED EMBODIMENT

The present invention now will be described more fully hereinafter with reference to the accompanying drawings, which form a part hereof, and which show, by way of illustration, specific exemplary embodiments by which the invention may be practiced. This invention may, however, be embodied in many different forms and should not be construed as limited to the embodiments set forth herein; rather, these embodiments are provided so that this disclosure will be thorough and complete, and will fully convey the scope of the invention to those skilled in the art. Among other things, the present invention may be embodied as methods or devices. Accordingly, the present invention may take the form of an entirely hardware embodiment, an entirely software embodiment or an embodiment combining software and hardware aspects. The following detailed description is, therefore, not to be taken in a limiting sense.

Throughout the specification and claims, the following terms take the meanings explicitly associated herein, unless the context clearly dictates otherwise.

The phrase "in one embodiment" as used herein does not necessarily refer to the same embodiment, though it may.

As used herein, the term "or" is an inclusive "or" operator, and is equivalent to the term "and/or", unless the context clearly dictates otherwise.

The term "based on" is not exclusive and allows for being based on additional factors not described, unless the context clearly dictates otherwise.

Throughout the specification, the meaning of "a," "an," and "the" include plural references. The meaning of "in" includes "in" and "on."

Briefly stated, the present invention is directed to a system, apparatus, and method for managing and coordinating a sales system having multiple sales partners, where each sales partner has non-exclusive rights to sell goods or services to customers. The system provides a mechanism whereby a partner can register a potential sale, and gain some level of exclusivity with respect to the particular sale, for at least a period of time. The system also provides a mechanism whereby a company may distribute potential sales opportunities among sales partners. In one aspect of the invention, the system provides portals to various entities, such as a company, distributors, and partners. The portals provide a mechanism for sharing information as well as hiding information, and enforce certain access rules.

Figure 1:
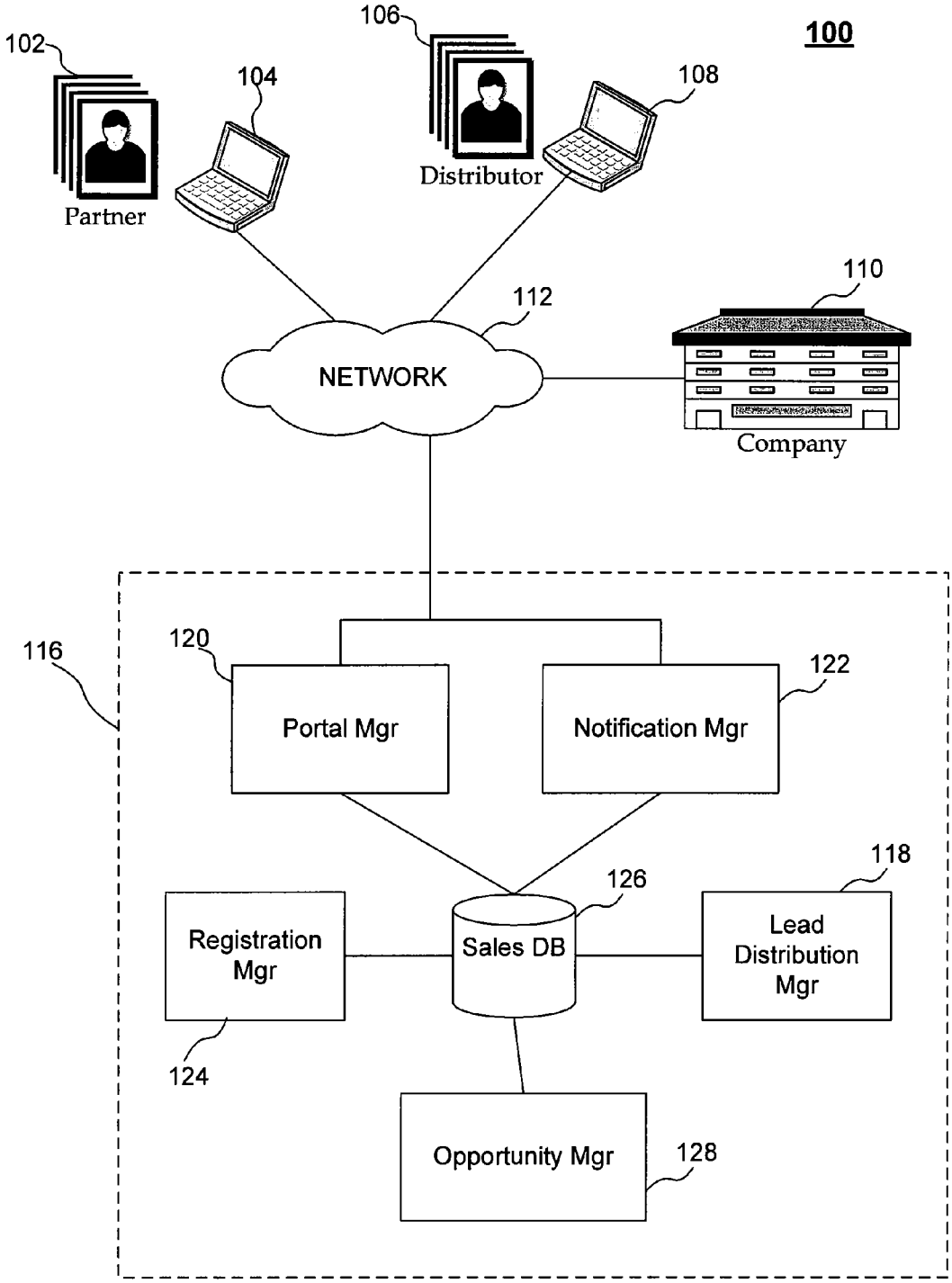
FIG. 1 is a system diagram of an environment in which the invention may be practiced.

FIG. 1 illustrates a portion of an exemplary environment 100 in which the invention operates, according to one embodiment of the invention. The environment includes three entities: a sales partner 102, a distributor 106, and a company 110. In practice, an environment may include multiple sales partners and multiple distributors. However, for purposes of simplicity, only one sales partner 102 and one distributor 106 are illustrated.

A sales partner (or simply, "partner") represents the company 110 in the process of selling one or more products of the company. A sales partner typically has direct contact with customers and potential customers. As used herein, a partner may be an individual, a group of individuals, or a business entity. A partner may be an employee or a non-employee of the company.

A distributor 106 may receive products from the company 110 and distribute them to one or more partners 102. A distributor may maintain an inventory of products, and distribute products from this inventory. In one embodiment, a distributor may be an organization within the company. A distributor may have a distribution relationship with many partners, or as few as one partner. A partner may have a distribution relationship with one distributor, or with multiple partners.

A system having a company 110, one or more distributors 106 and one or more sales partners 102 is referred to as a three-tiered system, with the company 110 as the top tier, the distributor(s) 106 as the middle tier, and the partner(s) 102 as the bottom tier. Each tier may primarily work with the tier at the next level up or down.

In one embodiment, the company 110 sells products to the distributor 106 at a discount from the retail price of the product. The distributor, in turn, sells the product at a smaller discount to the sales partner. The sales partner sells the product to customers at a retail price. The discounts that each of the partners and distributors receive allow each party to receive a profit on products sold.

As illustrated in FIG. 1, partner 102 uses a client computer 104 to communicate over a network 112. Distributor 106 uses a client computer 108 to communicate over the network 112. Client computers (or simply "clients") 104 and 108 are each a computing device capable of connecting with other computing devices through one or more networks, such as network 112. The set of such devices can include devices that connect using one or more wired communications mediums, a wireless communications medium, or a combination of wired and wireless communications mediums. Clients 104 and 108 can be such devices as personal computers, multiprocessor systems, microprocessor-based or programmable consumer electronics, network PCs, cell phones, smart phones, pagers, PDAs, Pocket PCs, wearable computers, walkie talkies, radio frequency (RF) devices, infrared (IR) devices, CBs, integrated devices combining one or more of the preceding devices, and the like.

As used herein, references to partner 102 or distributor 106 sending data, receiving data, or communicating with other elements of the environment 100 imply that corresponding client devices 104 or 108 may be used to facilitate the communication.

Company 110 may be an individual, a group of individuals, or a business organization that manufactures, designs, buys, or otherwise acquires one or more products, or provides a service. The company may have one or more office locations where employees or agents work. Company 110 typically has a plurality of employees, each having assigned tasks which may include elements of this invention. To simplify this discussion, though there may be one or more company employees or agents involved in the various actions of the procedures disclosed herein, the term "company" is used to refer to any one or more of the people, as well as any client devices used by the people to communicate with other computing devices.

The environment 100 includes one or more networks 112. The network 112 can be a wide area network (WAN), a local area network (LAN), or a combination of interconnected WANs and LANs. The Internet is made up of a vast number of such interconnected networks, computers, and network devices that use the Transmission Control Protocol/Internet Protocol ("TCP/IP") suite of protocols to communicate with one another. Network 112 may include wired connections, such as cables, or wireless communication means.

The environment 100 further includes a data center 116. The data center 116 may include one or more server computers, which store program code and data to facilitate the invention. The data center 116, and the servers that make up the data center, may be at a single location, or may be geographically distributed at multiple locations. In embodiments having multiple servers, the servers may communicate through network 112, another network, direct connections, or any combination of these.

Network 112 couples partner 102, distributor 106 and company 110 to the data center 116. A virtual private network (VPN) or other mechanism for providing secure communication may be used for these communications. A secure communication protocol, such as SSL or TLS, may be used. One or more intermediate network devices, such as routers, traffic managers, firewalls, or accelerators may process or manage any portion or all network traffic discussed herein.

Data center 116 may include a number of components that are used to practice the invention. FIG. 1 illustrates one configuration of components, each having one or more designated functions. However, the functions of these components may be combined, distributed, or duplicated in a number of ways in accordance with the present invention. It is to be understood, therefore, that unless otherwise stated, reference to a particular component may include a variety of mechanisms for implementing and arranging the component.

As illustrated in FIG. 1, data center 116 includes a portal manager 120, a notification manager 122, a registration manager 124, a lead distribution manager 118, an opportunity manager 128, and a sales database 118. Very briefly, each of these components may perform the following functions, as well as other functions.

The portal manager 120 provides a portal, such as a web-based portal, with which the partner 102, the distributor 106, and the company 110 interact. The notification manager 162 sends notifications of various events to one or more of a partner, a distributor, or the company. The registration manager 124 processes the registration of sales deals. The lead distribution manager processes the distribution of each sales lead to a partner. The opportunity manager 128 processes sales opportunities. The sales database (DB) is used to store and retrieve data pertaining to partners, distributors, potential or actual customers, leads, opportunities, statuses, and additional information. The operation of each of these components is described in more detail below.

As used herein, a sales lead may be considered to be a candidate sales opportunity, and both terms are used interchangeably herein. A candidate sales opportunity is one that has received little or no filtering for a likelihood of resulting in an actual sales transaction within a reasonable time frame. After an entity, such as the company sales team, communicates with and receives additional information from the potential customer associated with the sales deal, a determination is made as to whether to convert the lead to a sales opportunity, based on one or more factors such as a level of interest by the potential customer, an amount of money to spend, needs of the potential customer, suitability of the product to the customer's needs, timing of any desired purchases, whether the potential opportunity is duplicative or conflicts with another sales deal, and the like. If a positive determination is made, the lead is considered to be qualified, and the action of designating the lead as an opportunity is considered to be a qualification. A lead that is qualified is then converted to be an opportunity.

As used herein, the terms "sales deal," or simply "deal," are used to refer to a sales lead or an opportunity. Thus, a deal that originates as a lead and progresses to an opportunity may continue to be referred to as a deal.

Figure 2:
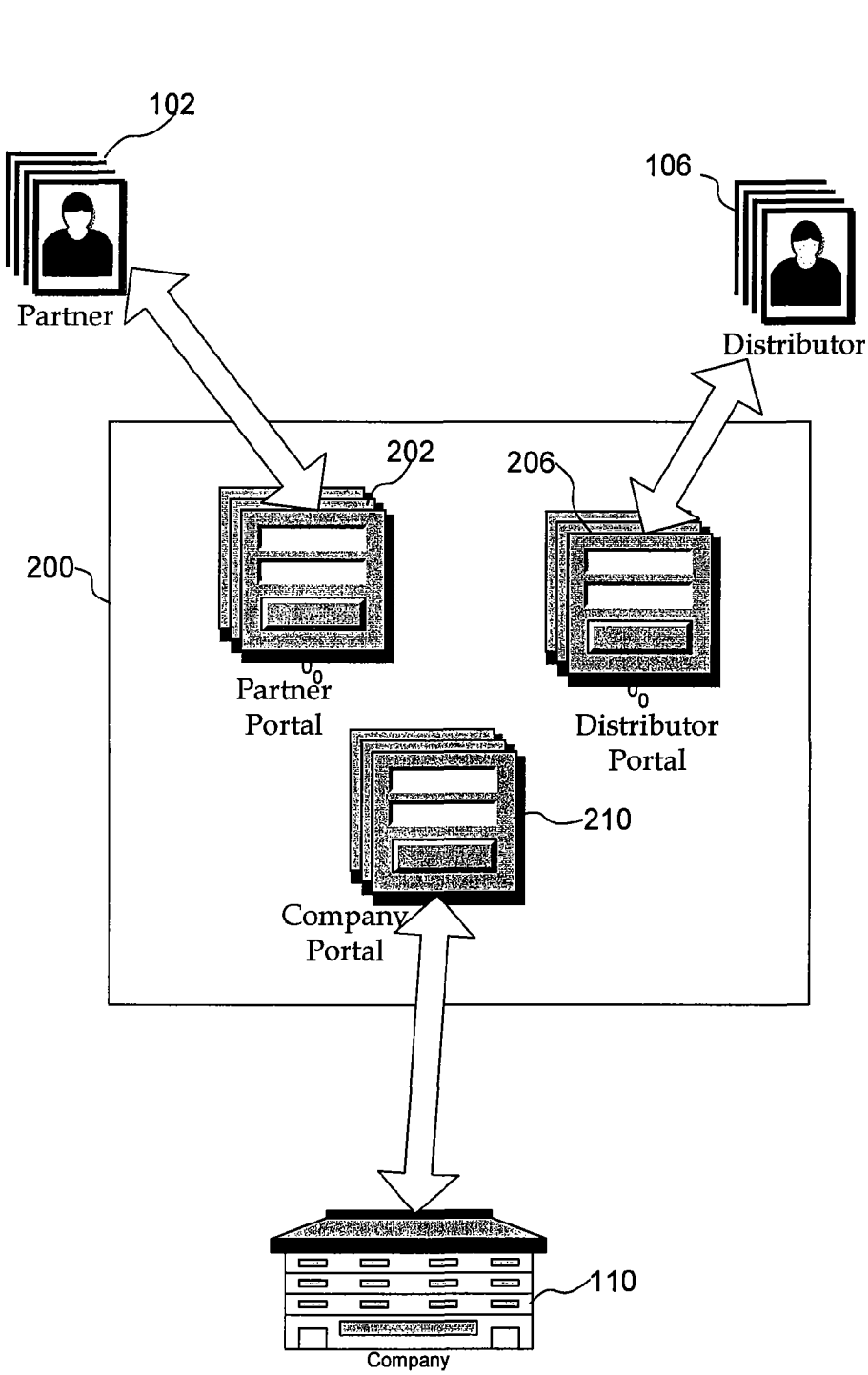
FIG. 2 is a conceptual view of a sales portal in accordance with an embodiment of the invention.

FIG. 2 illustrates a conceptual view of a sales portal 200 in accordance with an embodiment of the invention. A portal is an interface mechanism that includes data and one or more interfaces to one or more entities in the environment of the invention. The interface may be personalized, depending on which entity is interacting with it.

More specifically, in one embodiment, the sales 200 portal may be implemented as a web site, with a collection of one or more web pages. The sales portal may comprise a number of portals, each one personalized to a type of entity, or to a specific entity. For example, in one embodiment, the sales portal 200 includes: a partner portal 202, which interfaces with partners 102; a distributor portal 206, which interfaces with distributors 106, and a company portal 210, which interfaces with company 110.

Each of these portals may be further subdivided. For example, each partner 102 may have a personalized partner portal; each person or group in the company 110 may have a corresponding personalized portal. When a person or entity logs into the sales portal, the portal manager provides to the corresponding portal. Each portal has a corresponding set of data and rights to the data. For example, the company accessing the company portal may have the ability to view and modify a specific datum. A distributor accessing the distributor portal may have the ability to view, but not modify the same datum, while a partner accessing the partner portal may be prevented from viewing the same datum. As such, the partner portal, the distributor portal, and the company portal are conceptual, each providing an interface and respective data sets in the sales DB. The portal manager 120 may contain the logic that manages these actions. Additionally, an entity's portal may provide the entity with an ability to modify the portal of another entity. Modifications can include modifications to data, access rights, user interface, or other aspects of the portal. For example, the company may use the company portal to restrict, or to remove restrictions on, data viewed by a partner. In some situations the sales portal may be programmed to automatically change a portal in response to changes made at another portal. For example, a company may change a status of a sales opportunity at a company portal, resulting in additional, or more restrictive, access rights to a partner associated with the opportunity. As another example, after setting or changing the partner assigned to an opportunity the portal logic automatically result in access rights to the assigned partner, or loss of access to a partner that is unassigned.

Figure 3:
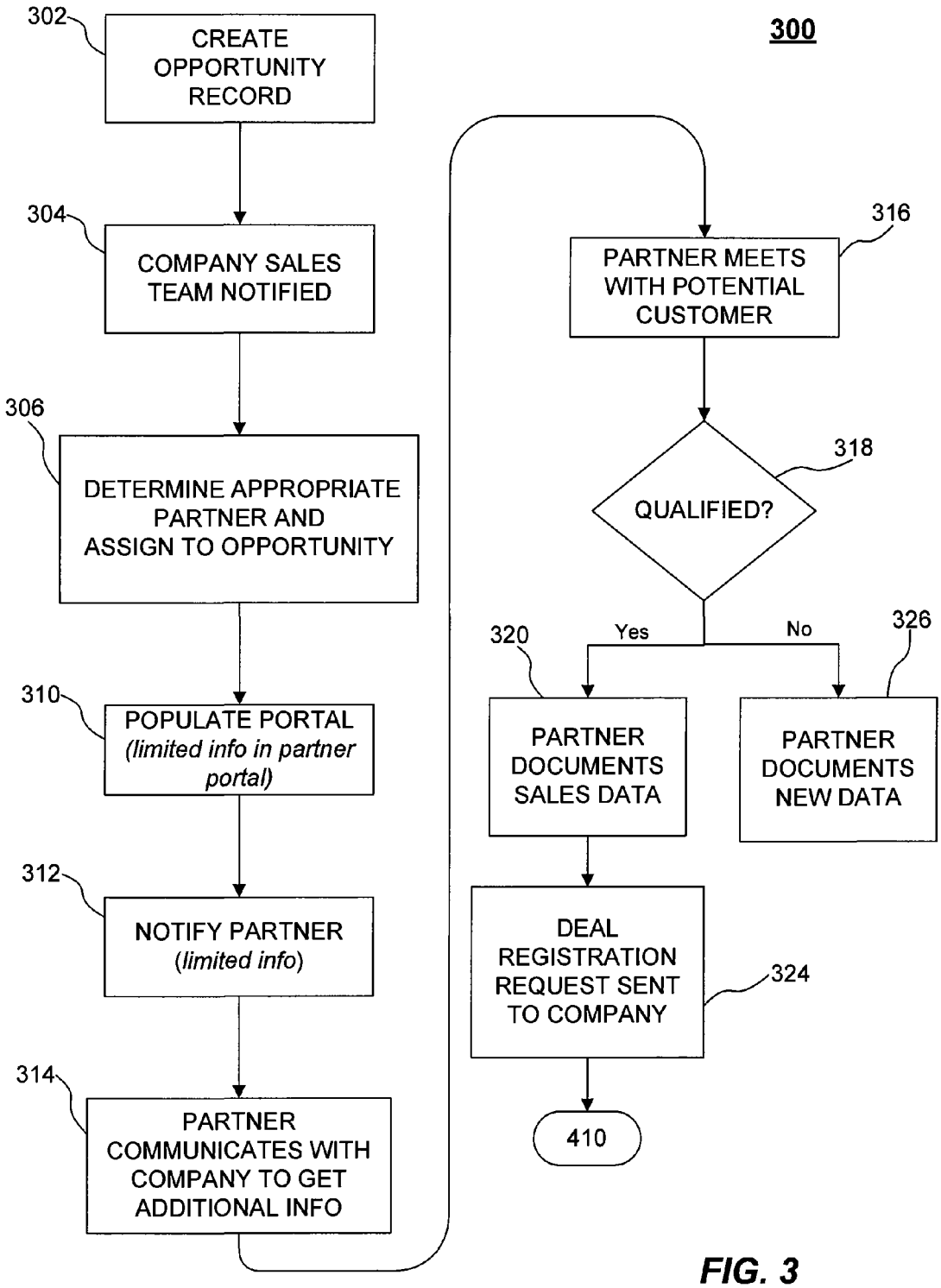
FIG. 3 is a flow chart illustrating a process of providing sales opportunities to sales partners, in accordance with an embodiment of the present invention.

FIG. 3 illustrates a process 300 for processing and distributing sales opportunities to partners, such as partner 102 of FIG. 1. As illustrated in FIG. 3, after beginning, at block 302 an opportunity record is created. This action may be performed by the opportunity manager 128. An opportunity record corresponds to a sales opportunity, and includes data that describes the sales opportunity. There are several types of events that may occur prior to or in conjunction with the creation of an opportunity record. For example, an inquiry from a potential customer may cause a lead to be created corresponding to the inquiry. This is sometimes referred to as an inbound query. After investigation or analysis, such as by company 110, the lead may be "qualified" and converted to an opportunity. Alternatively, the potential customer may be first contacted by the company 110 or a representative, and this action may result in a qualification of the potential customer and result in creation of an opportunity. This is sometimes referred to as an outbound opportunity creation. An inbound query, an outbound opportunity creation, or other actions, may result in the creation of the opportunity record at block 302.

At block 304, a company sales team is notified of the opportunity. The notification may be performed by the notification manager 122. In one implementation, the notification is performed by sending an email, although other mechanisms for notification may be used in place of, or in addition to, email. The sales team may include one or more people within the company 110 that are assigned the task of managing opportunities, as well as other tasks associated with the present invention.

At block 306, a determination is made of an appropriate partner to whom to assign the opportunity. This determination may be made by the sales team, or may be automated and performed by a computing device. One or more of a number of criteria may be used to determine the assignee partner. This may include a recent history of partners' activities, geography, skills, round robin, or random distribution. The determined partner is then assigned to the opportunity. The sales team may employ the opportunity manager 128 to perform these actions.

In one embodiment, an assignment of a partner to an opportunity provides the partner with exclusive rights, with respect to other partners, to the opportunity, at least for a period of time. During this time, other partners are prevented by the system from registering a duplicate or conflicting opportunity, and a duplicate or conflicting opportunity is not assigned to the other partners. For example, an opportunity may be registered for a period of 90 days, although longer or shorter periods of time may be used. In one embodiment, a partner may extend, or at least request to extend, the specified period of time. In one embodiment, at or near the end of the period of time, the registration of the opportunity expires, and the partner is automatically removed as the partner associated with the opportunity. The notification manager may send a notification of this event. It may also send a warning notification at a time prior to the expiration. Upon expiration, a different partner may register a sales opportunity that is duplicative, or partially duplicative, of the expired opportunity.

At block 310, the partner portal is populated with data related to the opportunity. As indicated in the above discussion of FIG. 2, this action may be performed by the company interacting with the company portal, entering data, setting status information, and controlling the partner's ability to view certain data. In one embodiment, the data that is populated in the partner portal (and therefore accessible to the partner) is limited in a way such that the partner will be motivated to communicate with the company prior to contacting the potential customer. For example, the contact information for the potential customer may be excluded from the partner's view. Historical notes or information pertaining to the potential customer or contact person may be excluded from the partner's view.

At block 312, the notification manager may notify the selected partner of the opportunity. The selected partner may receive opportunity information in the notification, or may communicate with the partner portal to obtain the information.

At block 314, the partner may communicate with the company to obtain additional information. For example, at the block 314, the company may provide the contact information of the potential customer. This communication may be in one or more of a number of ways, including emails, telephone, and other types of communication. This communication may include an exchange of additional information, such as customer objectives, technology solutions deployed within the customer business, access to budget data, technical questions, problems, or comments, references to employees within the customer business, or other specific issues being faced within the customer business.

At block 316, the partner may communicate with, or meet with, the potential customer. Various sales communications may occur at this time. At a decision block 318, a determination is made as to the qualification of the customer. As discussed above, creating an opportunity includes some amount of qualification of the customer. At the block 318, a higher level of qualification is performed. It may be considered to be a second level of filtering of the opportunity.

If, at the decision block 318, the opportunity survives the higher level of qualification, processing proceeds to block 320, where the partner documents additional sales data. In one embodiment, the partner may interface with the partner portal 202, providing data such as type of product, number of each product, relevant dates, product applications, important product features, and the like.

At block 324, a deal registration request is sent to the company. A confirmation may also be sent to the partner. This may be at least partly performed by the registration manager 124. The notification manager 122 may also be used. The process may then continue in a manner such as that described in FIG. 4 below. More specifically, the actions of blocks 320 and 324 are similar to the actions of blocks 406 and 408, described below, and the process may continue at the block 410.

If, at the decision block 318, it is determined that the opportunity is not qualified at the higher level, flow proceeds to block 226, where the partner documents relevant data. This data may include reasons why the opportunity did not qualify at the higher level. This documentation may occur at the partner portal.

Figure 4:
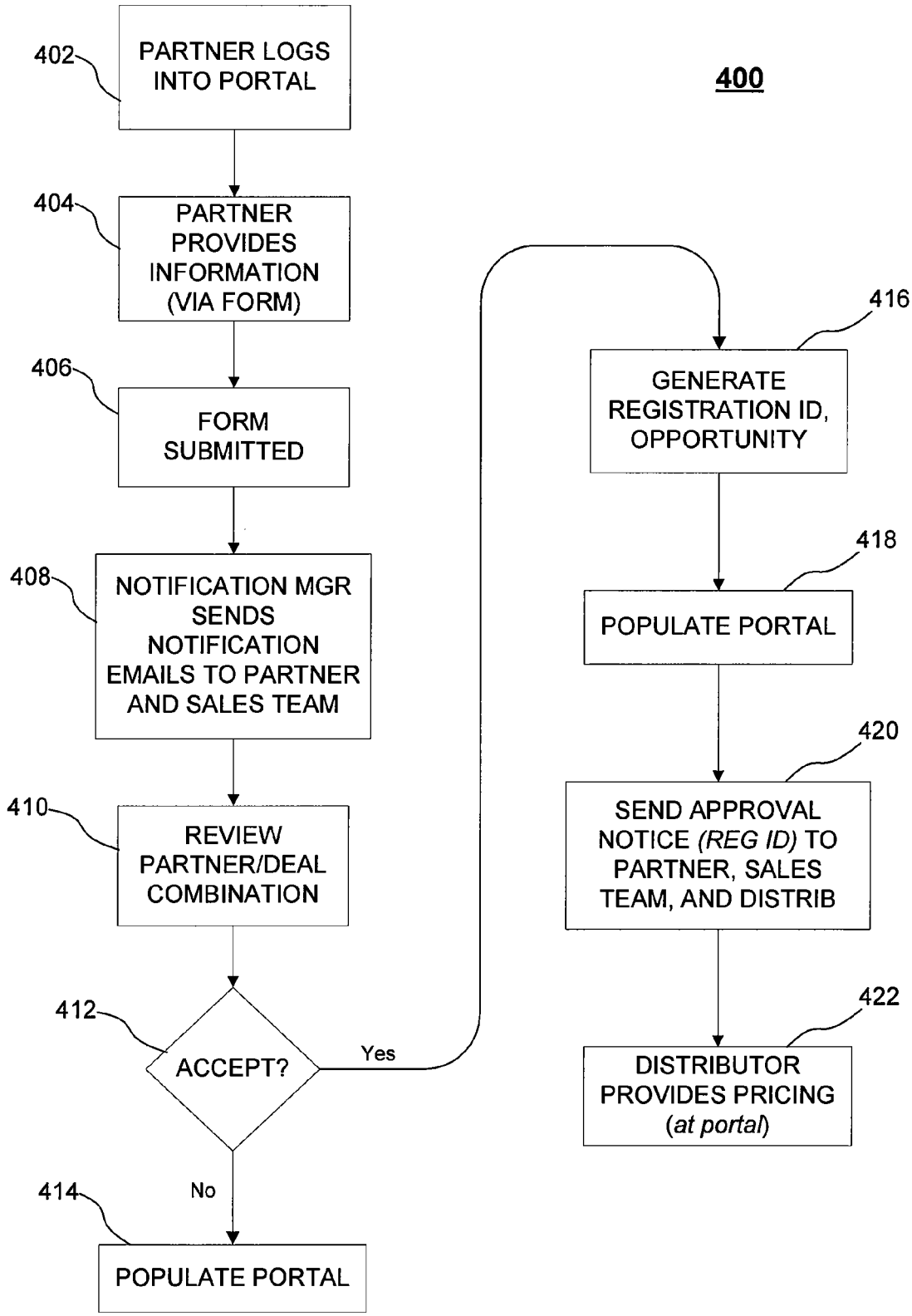
FIG. 4 is a flow chart illustrating a process of registering and processing sales opportunities, in accordance with an embodiment of the present invention.

FIG. 4 illustrates a process 400 for registering sales deals, in accordance with an embodiment of the invention. As illustrated in FIG. 4, after beginning, at block 402 a sales partner begins an exchange of information with a partner portal, such as partner portal 202 of FIG. 2. This exchange may be initiated by the partner logging into the partner portal.

At block 404, the partner provides information related to a sales lead or opportunity to the partner portal. In one embodiment, this may include using an Web-based form. The provided information may include data such as potential customer contact information, location, products of interest, product quantities, expected transaction dates, likelihood of a sale, and other information that relates to a sales opportunity.

At block 406, the form, if a form is used, is submitted to the partner portal. In various embodiments, a plurality of forms may be used to submit the information. Other forms of communication may be used as an alternate or supplementary way of exchanging information. The other forms may include one or more of text messaging, email, voice communication, and the like.

At block 408, notifications are sent to one or more recipients. A confirmation may be sent, by email or other communication, to the partner that entered the information. A notification may be sent to a sales team in the company 110 (FIG. 1). The notification manager 162 may be used to generate and send these notifications.

At block 410, the information relating to the lead or opportunity is reviewed. This review may be performed by the company sales team, by an automated process, or a combination of both. In one embodiment, a distributor 106 may perform at least part of the review. This review process may include actions such as determining whether the deal is a duplicate of one already received; determining whether the partner has sufficient credit to participate in the deal; or other such factors. Any one or combination of these factors could be the basis for rejecting the lead or opportunity.

At a decision block 412, a determination is made whether to accept the lead or opportunity. If rejected, the process flow may proceed to block 414, where the portal is populated with the information relating to the analysis and the rejection. This action may include a member of the sales team entering information at the company portal 210.

If, at the decision block 412, the lead or opportunity is accepted, the process flow proceeds to block 416, where a registration identifier (REGID) is generated. The REGID may be in any of a number of formats that are useful to identify the lead or opportunity in future actions. In one embodiment, the action of block 416 is performed prior to the decision block of 412, such that a REGID is created even for those leads or opportunities that are subsequently rejected. For example, a REGID may be created in response to the form submission of block 406 and prior to the notifications of block 408.

At block 418, the portal is populated with various information. In one embodiment, this action is performed by the company 110 at the company portal 210. The information, or a subset thereof, may be accessible at the partner portal by the partner associated with the lead or opportunity.

At block 420, an approval notice is sent to one or more of the partner, the company sales team, or the distributor. In one embodiment, the approval notice is sent to all of these entities. In one embodiment, the approval notice includes the associated REGID, which can be used by any of the recipients to access information pertaining to the sales opportunity at a respective portal.

At block 422, a distributor that is associated with the partner and the sales opportunity provides data pertaining to pricing. This action may be performed in response to receiving the approval notice discussed at the block 420. The distributor may provide the pricing data by logging in and entering the data at the associated distributor portal. This data, or a portion thereof, may be accessible to the partner at the partner's corresponding partner portal. The pricing data may include a discount, or a schedule of discounts, that the partner may receive for the products that are sold in relation to the current opportunity. As discussed above, a product may have a retail price that is established by the company. The distributor may purchase the product with a distributor discount from the retail price. A partner may purchase the product with a partner discount from the retail price. This partner discount may be included in the pricing provided by the distributor at the block 422.

In various embodiments, the pricing may include a schedule of discounts, and may refer to multiple products. For example, the discount may vary based on a number of units sold. Each product may have discounts corresponding to the product, and discounts may vary by product. Additional factors may be incorporated into the provided discount, such as variations on the discount based on the date of the sale, accessories or services included in the sale, and the like. The partner may then receive the pricing data at the partner portal.

Following the process 400 of registering sales opportunities, a partner may complete a sales transaction contemplated by the opportunity. In one embodiment, completing a sales transaction may include receiving a purchase order, transferring one or more products from a distributor to a customer, receiving a payment from the customer, and sending a payment to the distributor. Data relating to completed actions or transaction status may be provided by the partner at the partner portal, and monitored by a sales team at the company portal.

The discussion herein discloses a bidirectional characteristic of the system. That is, the partner portal, the distributor portal, and the company portal are each used by the partner, the distributor, and the company, respectively, to store and provide information to each of the other parties. Each portal is used by the respective party to receive information from each of the other parties. Additionally, the system may be configured so that at least a portion of information pertaining to a particular sales opportunity may be received by the company, but not by the associated partner, or not by the associated distributor.

The system discussed herein may be used by a partner to request information or materials. For example, a partner may indicate a desire for marketing materials. A partner may indicate a desire for an evaluation unit of a product. The latter request may be forwarded to an associated distributor or the company, either of which may respond. A product unit may be sold, leased, or loaned to a partner. In one embodiment, a distributor may maintain an inventory of evaluation units that are configured and provided to partners in response to such requests.

Figure 5:
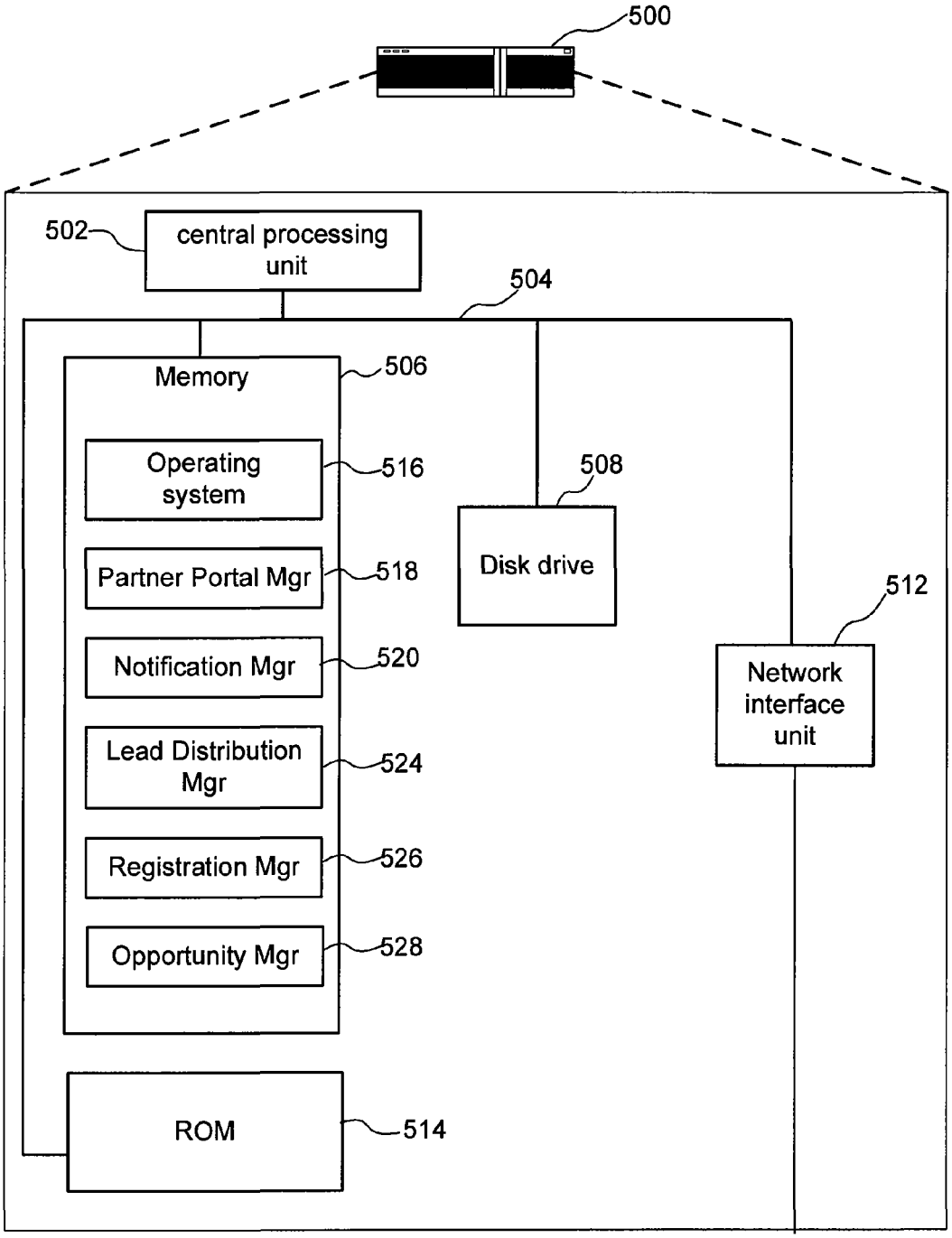
FIG. 5 is a block diagram of a server computer that may be used to implement the present invention.

FIG. 5 illustrates one embodiment of a network device that may operate as any one or more of the servers that make up the data center of FIG. 1. Server 300 of FIG. 5 may include many more or less components than those shown. The components shown, however, are sufficient to disclose an illustrative embodiment for practicing the invention.

As illustrated in FIG. 5, server 500 includes a central processing unit (CPU) 502, mass memory, and a network interface unit 512 connected via a bus 504. Network interface unit 512 includes the necessary circuitry for connecting server 500 to network 112 of FIG. 1, and is constructed for use with various communication protocols including the TCP/IP and UDP/IP protocol. Network interface unit 512 may include or interface with circuitry and components for transmitting messages and data over a wired and/or wireless communications medium. Network interface unit 512 is sometimes referred to as a transceiver, Network Interface Card (NIC), or the like.

Computer storage media may include volatile and nonvolatile, removable and non-removable media implemented in any method or technology for storage of information, such as computer readable instructions, data structures, program modules or other data. Examples of computer storage media include RAM 506, disk drive 508, ROM 514, EEPROM, flash memory and/or any other memory architecture, CD-ROM, digital versatile disks (DVD) and/or any other optical storage, magnetic cassettes, magnetic tape, magnetic disk storage and/or any other magnetic storage devices, and/or any other medium that can store information that can be accessed by a computing device.

Server 500 may also include an input/output interface (not shown) for communicating with external devices or users.

The mass memory generally includes random access memory ("RAM") 506, read-only memory ("ROM") 514, and one or more permanent mass storage devices, such as hard disk drive 508. The mass memory stores operating system 516 for controlling the operation of server 500. The operating system 516 may comprise an operating system such as UNIX, LINUX™, or Windows™. In one embodiment, the mass memory may store program code and data for implementing sales database 118, opportunity manager 128, portal manager 130, notification manager 122, registration manager 124 and/or lead distribution manager 126. These components may be distributed or duplicated in a variety of ways across different types of memory, or two or more servers. Each component may also be subdivided and distributed or duplicated across two or more servers.

It will be understood that each block of the flowchart illustrations, and combinations of blocks in the flowchart illustrations, can be implemented by computer program instructions. These program instructions may be provided to a processor to produce a machine, such that the instructions, which execute on the processor, create means for implementing the actions specified in the flowchart block or blocks. The computer program instructions may be executed by a processor to cause a series of operational steps to be performed by the processor to produce a computer implemented process such that the instructions, which execute on the processor to provide steps for implementing the actions specified in the flowchart block or blocks.

It will be further understood that the sequence of actions in the described processes may vary, in various implementations of the invention. Unless a specific sequence is logically required or explicitly stated, the ordering of events is therefore not limited to a sequence illustrated or described herein.

The above specification, examples, and data provide a complete description of the manufacture and use of the composition of the invention. Since many embodiments of the invention can be made without departing from the spirit and scope of the invention, the invention resides in the claims hereinafter appended.

We claim:

1. A system for managing a plurality of sales partners, comprising:

a company portal that receives at least a first portion of information relating to a sales deal between a potential customer and a company;

a partner portal that receives, from a sales partner that represents the company for selling one or more products of the company, at least a second portion of information relating to the sales deal, wherein the sales partner has exclusivity with respect to the sales deal for at least a period of time such that another sales partner is excluded by the system from registering a duplicate sales opportunity corresponding to the sales deal;

a database that stores the first and second portions of information relating to the sales deal; and wherein:

the company portal is employed to create a sales opportunity record corresponding to the sales deal if the potential customer meets at least one qualification factor, wherein the sales opportunity record includes the first and second portions of information; and the partner portal is employed to, in response to the creation of the sales opportunity record, provide at least a portion of the sales opportunity record to the sales partner.

2. The system of claim further comprising:

a distributor portal that provides at least a third portion of information relating to the sales deal to a distributor; and wherein:

the distributor portal receives pricing information corresponding to the sales opportunity record.

3. The system of claim 1, wherein:

in response to the creation of the sales opportunity record, the sales partner is selected from a plurality of sales partners.

4. The system of claim 1, wherein:

the partner portal is employed to receive, from the partner, a candidate sales opportunity; and the system is employed to convert the candidate sales opportunity to a sales opportunity.

5. The system of claim 1, wherein:

the partner portal is employed to receive, from the partner, a candidate sales opportunity; and the system is employed to selectively convert the candidate sales opportunity to a sales opportunity, at least partly based on a credit rating of the sales partner.

6. The system of claim 1, wherein:

the partner portal is employed to receive, from the partner, a candidate sales opportunity; and the system is employed to selectively convert the candidate sales opportunity to a sales opportunity, at least partly based on a determination of whether another sales partner has provided a conflicting candidate sales opportunity.

7. The system of claim 1, wherein:

the system is employed to generate a registration ID corresponding to the sales deal; and each of the company portal and the sales partner portal uses the registration ID to identify the sales deal.

8. The system of claim 2, wherein:

the system is employed to generate a registration ID corresponding to the sales deal; and each of the company portal, the distributor portal, and the sales partner portal uses the registration ID to identify the sales deal.

9. The system of claim 1, further comprising:

a notification component that performs actions, the actions comprising:

in response to the receipt of the first portion of information, sends a notification message to the sales partner; and in response to the receipt of the second portion of information, sends a notification message to the company.

10. The system of claim 1, further comprising:

a notification component that, in response to a status change of the sales opportunity record, sends a notification message to a distributor; and a distributor portal that receives pricing data from the distributor.

11. The system of claim 1, further comprising means for assigning the sales opportunity to the first sales partner.

12. The system of claim 1, further comprising means for receiving pricing data associated with the sales opportunity from a distributor.

* * * * *